US006293131B1

(12) United States Patent
Lemettinen et al.

(10) Patent No.: US 6,293,131 B1
(45) **Date of Patent: *Sep. 25, 2001**

(54) LOCK CASING TO BE INSTALLED IN A DOOR OR THE LIKE

(75) Inventors: Jaakko Lemettinen; Juha Raatikainen; Ari Pirinen, all of Joensuu (FI)

(73) Assignee: Abloy Oy, Joensuu (FI)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/211,760

(22) Filed: Dec. 15, 1998

(30) Foreign Application Priority Data

Dec. 16, 1997 (FI) ..... 974523

(51) Int. Cl.[7] ..... E05B 47/06; E05B 63/00

(52) U.S. Cl. ..... 70/278.7; 70/279.1; 70/451; 70/461; 292/169.14; 292/337; 292/DIG. 60

(58) Field of Search ..... 70/461, 451, 278.7, 70/279.1; 292/169.14, DIG. 60, 1.5, 337

(56) References Cited

U.S. PATENT DOCUMENTS

| | | | | |
|---|---|---|---|---|
| 656,808 | * | 8/1900 | Carleton | 70/283 |
| 1,462,826 | * | 7/1923 | Rixson | 70/461 |
| 1,672,076 | * | 6/1928 | Munson | 70/461 |
| 1,701,790 | * | 2/1929 | Morin, Jr. | 70/461 |
| 2,677,443 | * | 5/1954 | Kottick | 70/451 |
| 3,702,549 | * | 11/1972 | Solovieff et al. | 70/451 X |
| 3,890,608 | * | 6/1975 | Peterson | 292/144 X |
| 4,338,806 | * | 7/1982 | Cox | 70/422 X |
| 4,498,694 | * | 2/1985 | Warwick | 292/1.5 X |
| 4,593,543 | * | 6/1986 | Stefanek | 292/144 X |
| 4,677,834 | * | 7/1987 | Hicks | 292/144 X |
| 4,763,499 | * | 8/1988 | Boyle | 70/451 X |
| 4,902,053 | | 2/1990 | Hakkarainen et al. | 292/144 |
| 5,246,258 | | 9/1993 | Kerschenbaum et al. | 292/144 |
| 5,906,403 | * | 5/1999 | Bestler et al. | 292/DIG. 60 X |
| 5,918,916 | * | 7/1999 | Kajuch | 292/169.14 X |

FOREIGN PATENT DOCUMENTS

| | | | |
|---|---|---|---|
| 338464 | | 6/1921 | (DE) . |
| 622489 | | 11/1935 | (DE) . |
| 1 064 377 | | 8/1959 | (DE) . |
| 2012546 | * | 9/1971 | (DE) 70/461 |
| 87 02 013 | | 3/1987 | (DE) . |
| 2 203 794 | | 10/1988 | (GB) . |
| 675209 | * | 11/1964 | (IT) 292/144 |
| 437 393 | | 2/1985 | (SE) . |

* cited by examiner

*Primary Examiner*—Lloyd A. Gall
(74) *Attorney, Agent, or Firm*—John Smith-Hill; Smith-Hill and Bedell

(57) ABSTRACT

A lock casing comprises a case-like lock housing and a follower unit which is releasably fastened to the lock housing at an adjustable distance from the front plate of the lock casing. The follower unit includes a follower element which is turnable in the follower unit about an operating axis and is accessible from at least one side of the door for turning by means of a key operated locking mechanism. Force transmitting elements provide a force transmitting connection between the follower element and the bolt of the lock casing.

22 Claims, 5 Drawing Sheets

Fig. 1b
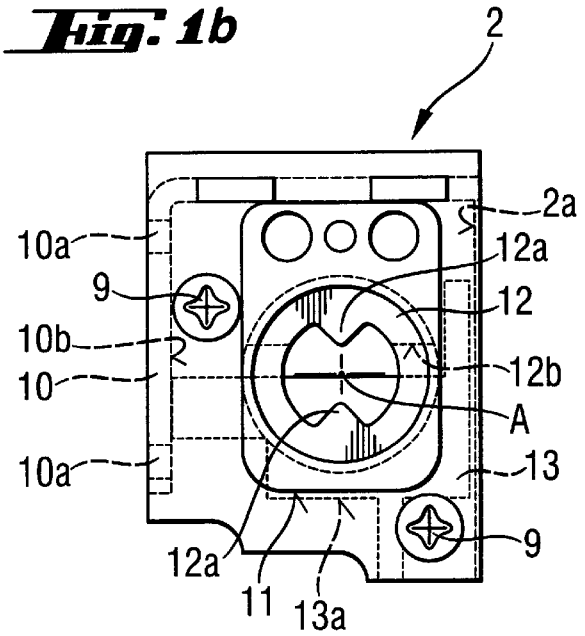
Fig. 1c
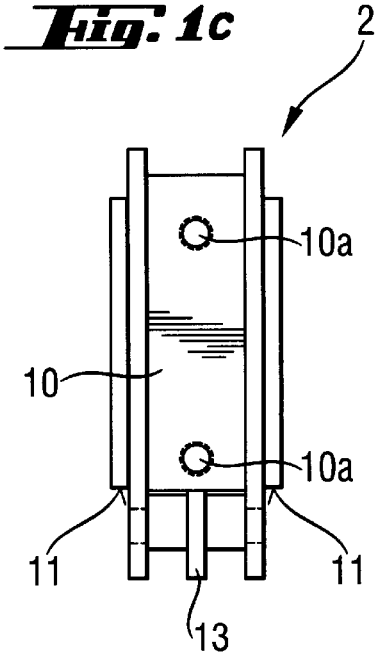
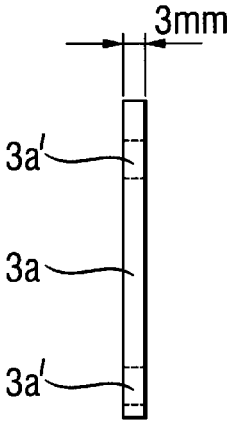
Fig. 1d
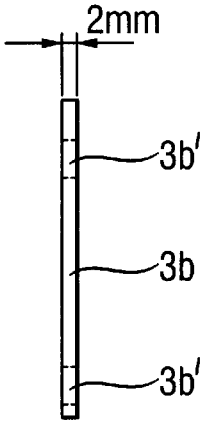
Fig. 1e

LOCK CASING TO BE INSTALLED IN A DOOR OR THE LIKE

BACKGROUND OF THE INVENTION

The invention relates to a lock casing to be installed in a door or the like.

A lock casing to be installed in a door or the like may include a front plate which is attached to the door at its edge and a follower element which is turnable in the lock casing about an operating axis by means of an operating device, such as a key operated locking mechanism. The location of the operating axis depends on the position of the operating device.

Lock standards prescribe, for example, the manner in which the locking mechanism should be fastened to the lock casing, including the distance of the operating axis from the front plate of the lock casing. In fact, the distance of the operating axis from the front plate of the lock may vary quite substantially in the different lock standards. In order to meet the different standards with respect to distance of the operating axis from the front plate, several different versions of a lock casing are needed. The lock standards also prescribe mechanical characteristics of the locking mechanisms. The different standards with respect to the mechanical characteristics of the locking mechanism influence the operation and shaping of the force transmitting means located in the lock casing, so that different casing versions may be needed to provide the different force transmitting means. Hence the number of different lock casings needed in all may be rather great, which increases the manufacturing costs, the number of the items that must be held in inventory and, thus, the value of the inventory.

An aim of the invention is to provide a lock casing which avoids the drawbacks mentioned. A further aim of the invention is to provide a lock casing which avoids the drawbacks mentioned above and which can utilize operating principles corresponding to those of the bolt disclosed in U.S. Pat. No. 4,902,053 and which is provided with solenoid operated dead locking means.

SUMMARY OF THE INVENTION

According to the invention the operating axis is arranged to a separate follower unit, which is arranged to be separately fastened to the lock casing so that its distance from the front plate is adjustable. In this way a certain kind of a basic lock casing may be utilized which in each case is provided with a follower unit meeting the desired requirements. In addition when the distance of the follower unit from the front plate is adjustable, each key operated lock cylinder or locking mechanism meeting a different lock standard can be utilized with a follower unit of its own, the distance of which from the front plate is only changed according to need.

In practice the adjustment of the distance of the follower unit from the front plate can with advantage be accomplished by installing one or more adjustment elements or spacers between the front plate and the follower unit according to need. In this case the follower unit is with advantage fastened to the front plate itself by means of screws, which may also be utilized for fastening of the adjustment elements. For this purpose the adjustment elements are provided with openings for the screws.

In an advantageous embodiment of the invention the follower unit is provided with a first force transmitting element, which is movable by means of the follower element, and the lock housing is provided with a second force transmitting element. When the follower unit is fastened to the lock casing, the first force transmitting element cooperates with the second force transmitting element by making use of force transmitting surfaces of the force transmitting elements respectively. The respective extents of the force transmitting surfaces in the direction of adjustment of the follower unit are such that the force transmitting surfaces remain in force transmitting engagement with each other when the follower unit is adjusted in position over the whole available range of adjustment.

The follower unit is with advantage made case-like, having inner surfaces which serve as guiding surfaces for guiding the movement of the first force transmitting element in the direction of the front plate.

In order to provide a secure fastening of the follower unit to the lock housing the follower unit is installed partly inside of the lock housing to provide support for the follower unit in the direction of the operating axis, i.e. to hold the follower unit against movement along the operating axis. In addition the follower unit and the lock housing are provided with guiding members or guiding surfaces, which are arranged into mutual cooperation for supporting the follower unit in the longitudinal direction of the front plate, i.e. holding the follower unit against movement parallel to the longitudinal direction of the front plate.

The invention can with advantage be applied to a lock casing which is provided with a latch bolt which can be dead locked and which, when the dead locking is released, can be pressed inside the lock casing for opening or closing the door, and with a solenoid arranged to act on a force transmitting element providing for engaging the dead locking. In the case of the advantageous embodiment mentioned above, the force transmitting element on which the solenoid acts is located in the lock casing and is acted on by both the second force transmitting element and the solenoid independently of each other.

BRIEF DESCRIPTION OF THE DRAWINGS

In the following the invention is described in more detail, by way of example, with reference to the attached drawings, in which:

FIG. 1*b* shows a side view of a follower unit adapted to be fitted in the lock housing shown in FIG. 1*a*, FIG. 1*c* shows a view of the follower unit taken from the left of FIG. 1*b*, FIGS. 1*d* and 1*e* show side views of adjustment elements which can be fitted between the follower unit shown in FIGS. 1*b* and 1*c* and the front plate of the lock housing shown in FIG. 1*a*.

DETAILED DESCRIPTION

Figure 1A:
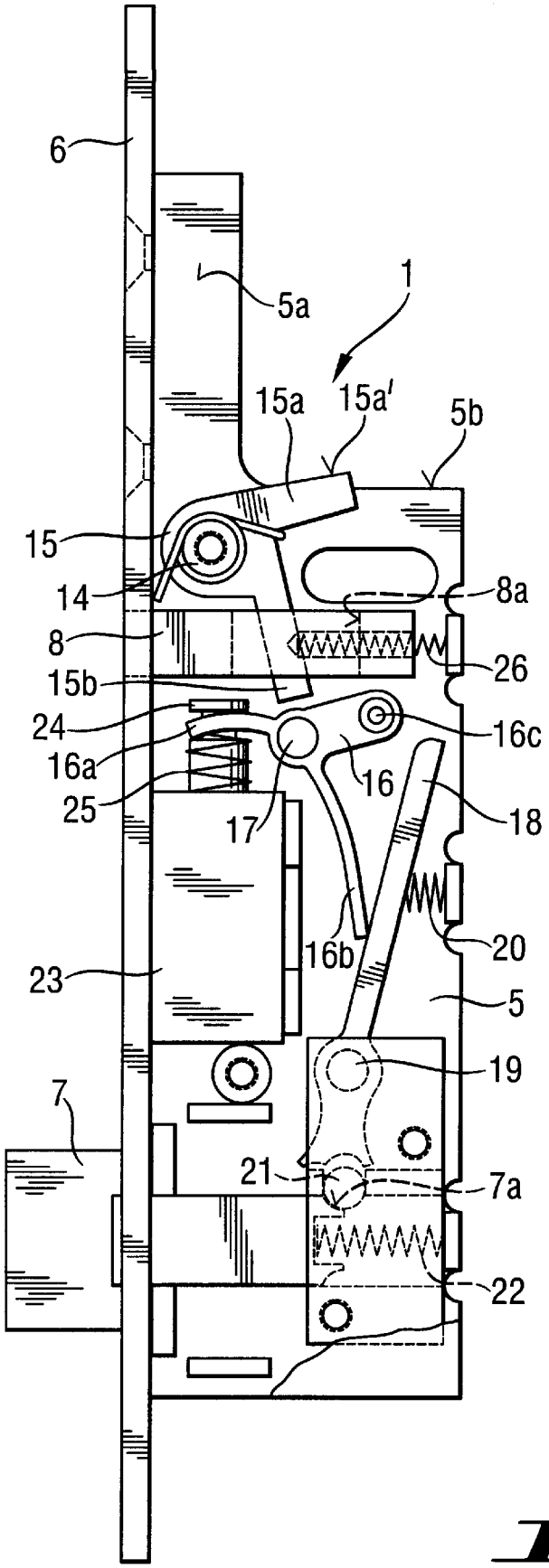
FIG. 1*a* shows a side view of the lock housing of a lock casing in accordance with the present invention with a side plate of the housing partially cut away.

In the drawings 1 indicates a lock casing to be installed into a door or the like and to which a separate follower unit 2 is fastened by means of screws 4 either directly or by making use of one or more adjustment elements or spacers 3*a* and/or 3*b,* which include openings 3*a*' and 3*b*' for the screws 4. By means of these two types of adjustment elements 3*a* and 3*b* having different thickness it will be possible in practice to take care of the installation of a lock casing with sufficient precision according to the requirements for the dimensions in different applications.

The lock casing 1 is provided with a front plate 6, a bolt 7, an auxiliary bolt 8, dead locking means and a number of force transmitting elements, which will be discussed later on. The bolt 7 and the auxiliary bolt 8 are urged by means of springs 22 and 26 into positions in which they protrude from the lock casing 1. The bolt 7 is of a type which includes a bevelled surface on either side so that if the bolt is in the protruding position and the dead locking means is in the releasing position, and one of the bevelled surfaces of the bolt is pressed against a striking plate in a door frame (not shown), the bolt 7 can be pushed from its protruding position into the lock casing 1, against the force of the spring 22, for opening or closing the door. For this part reference is made to U.S. Pat. No. 4,902,053, the entire disclosure of which is hereby incorporated by reference herein.

Figure 2:
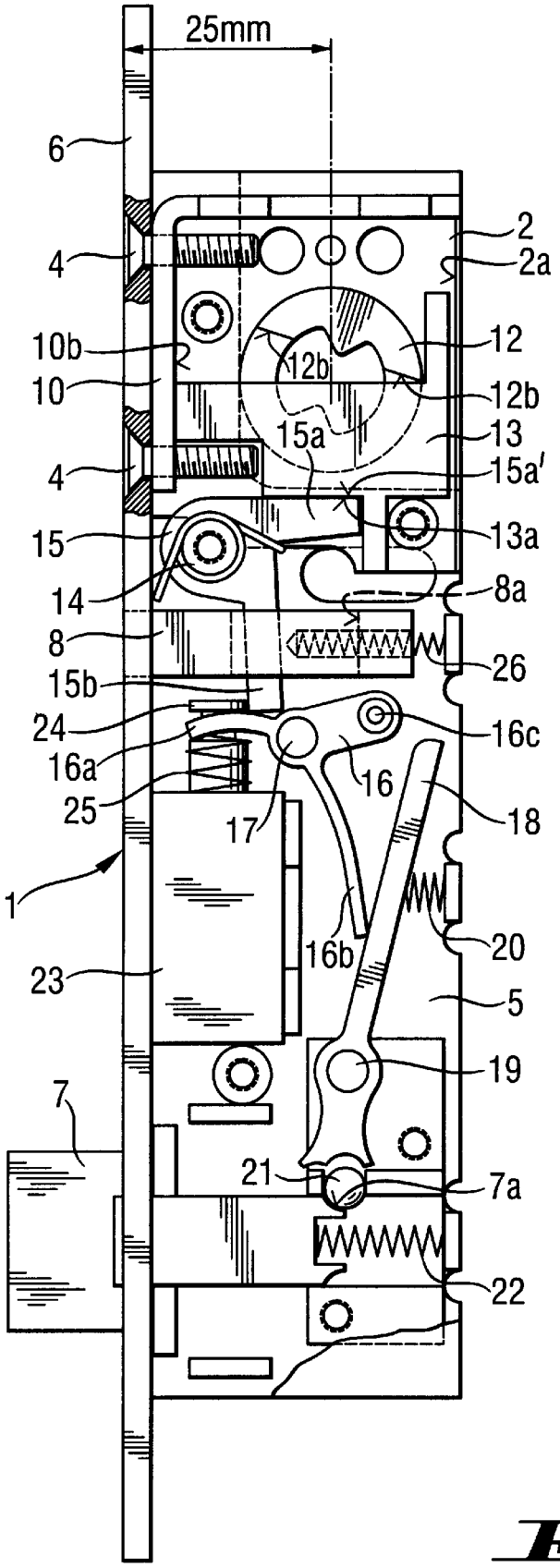
FIG. 2 shows the lock casing of FIG. 1 assembled in its basic form without any adjustment elements and the dead locking means in the releasing position.
Figure 3:
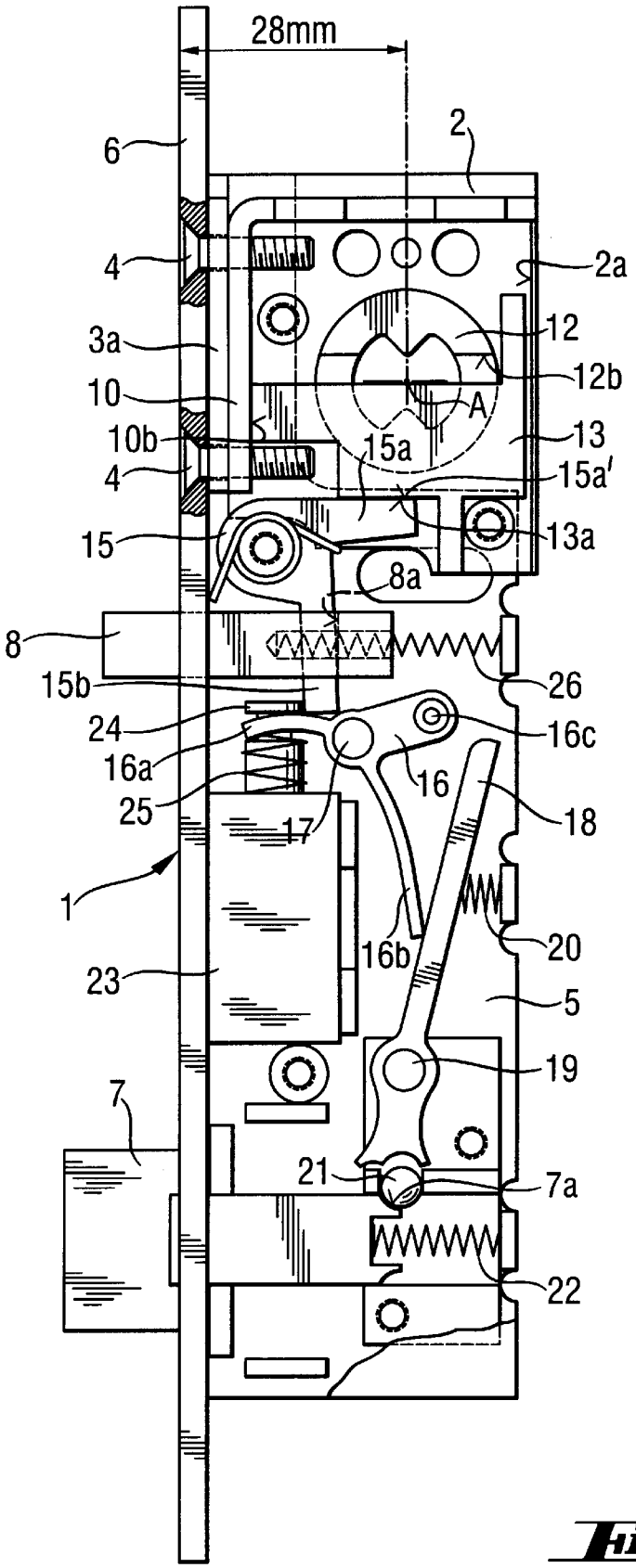
FIG. 3 shows the lock casing of FIG. 1 assembled with one adjustment element, the auxiliary bolt in a protruding position and the dead locking means in the releasing position.
Figure 4:
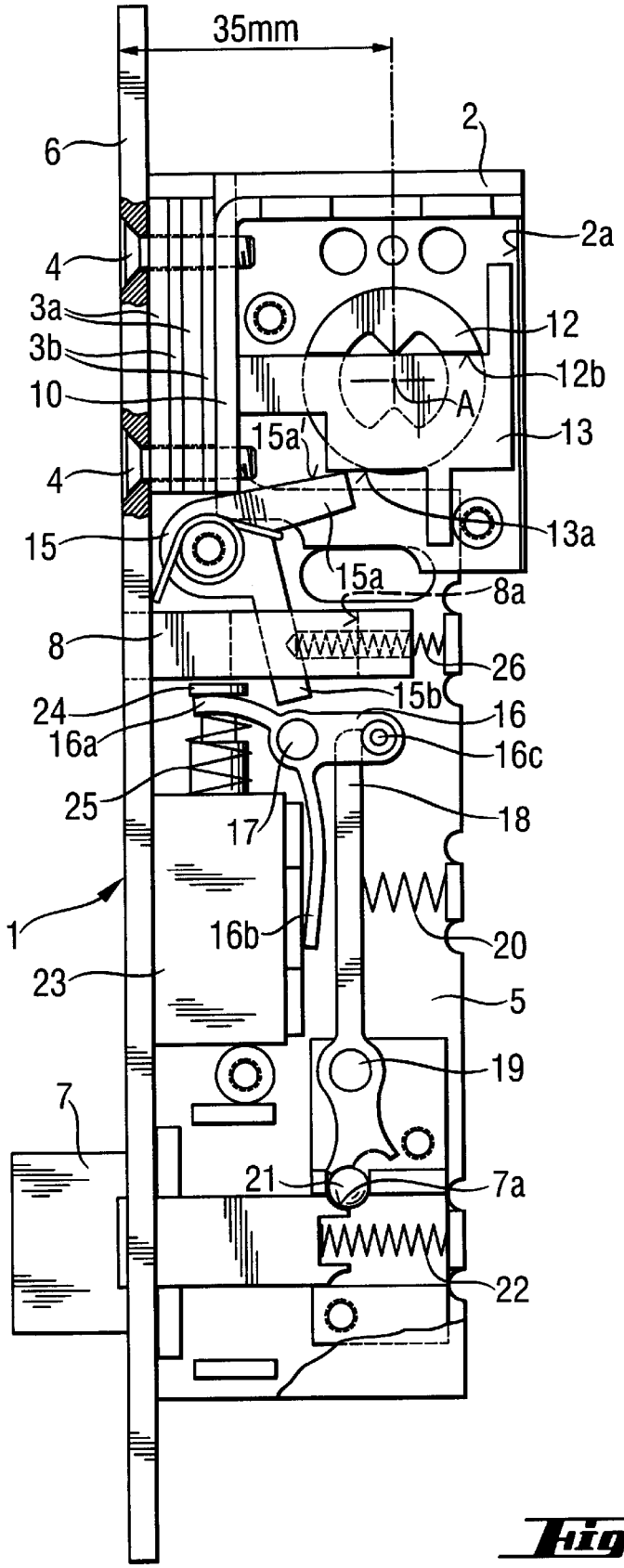
FIG. 4 shows the lock casing of FIG. 1 assembled with four separate adjustment elements and the dead locking means in the dead locking position.

The lock casing 1 includes a case-like lock housing 5, which is shown in the drawings with its cover plate largely cut away. The follower unit 2 is case-like, too, and its cover parts are fastened to each other by screws 9. In FIGS. 2–4 the follower unit 2 is shown with the upper cover part (the cover part nearer the viewer) removed. The follower unit 2 is provided with a fastening member 10 including screw openings 10*a* provided with screw threads, whereby the follower unit can be fastened to the front plate 6 by means of the screws 4. The fastening member 10 is bent to have an L-form so that it constitutes a part of the housing of the follower unit 2 and at the same time protects the force transmitting elements located inside the follower unit. When installed the follower unit 2 receives guidance additionally from inner surfaces 5*a* and a guiding edge 5*b* of the lock housing 5, the latter cooperating with a guiding edge 11 of the follower unit 2. The guiding edge 11 may be for instance a formation pressed into the cover part of the follower unit 2 when manufactured or an edge of a separate plate fixed to the cover part.

The follower unit 2 includes a follower element 12 which is mounted in the follower unit to be turnable about an operating axis A by force applied at least from one side of the door by means of a key operated locking mechanism (not shown). On the other side of the door for example a turn knob may also be used. In case there are operating devices on both sides of the door, separate respective follower elements 12, each turnable about the operating axis A, are installed in the follower unit 2. In the shown arrangement turning is accomplished in a way known as such by means of a torsion plate or the like acting on either one of followers 12*a.*

The follower unit 2 includes also a force transmitting element 13, to which the turning movement of the follower element 12 is transmitted through a force transmitting surface 12*b,* whereby the force transmitting element 13 moves downward in the figures guided by an inner surface 10*b* of the fastening member 10 and an inner surface 2*a* of the housing of the follower unit. The force transmitting element 13 has a force transmitting surface 13*a* which engages a force transmitting element 15, turnably journalled to a joint pin 14 in the lock casing, through a counter surface 15*a*' located on a protrusion or arm 15*a* of the element 15. As the force transmitting element 13 moves downward, its force transmitting surface 13*a* acts against the counter surface 15*a*' of the force transmitting element, which accordingly turns in the clockwise direction as seen in FIG. 2. The extent of the force transmitting surface 13*a* perpendicular to the longitudinal extent of the front plate 6 is such that the force transmitting relationship with the protrusion 15*a* is maintained even if even several adjustment elements 3*a* and/or 3*b* are installed between the follower unit 2 and the front plate 6.

The turning movement of the force transmitting element 15 acts by means of its second protrusion or arm 15*b* against a second force transmitting element 16 through its protrusion or arm 16*a*. The force transmitting element 16 is turnably journalled to a pin 17 and includes additionally a protrusion or arm 16*b*, which turns further a dead locking lever 18, turnably journalled to a pin 19, against the force of a spring 20 from the position shown in FIG. 4, in which dead locking is engaged, to the position shown in FIGS. 1*a,* 2 and 3 in which dead locking is released. Thus the dead locking lever 18 is urged by means of the spring 20 towards its dead locking position, in which it together with a ball-like dead locking member 21 acts on a dead locking surface 7*a* of the bolt 7 preventing movement of the bolt 7 into the lock casing 1. At the same time the dead locking lever 18 prevents movement of the dead locking member 21 into a position releasing the bolt 7.

In the embodiment shown the lock casing 1 includes also a solenoid 23, which is provided with a function member 24, which moves against the force of a spring 25 when current is switched on to the solenoid 23. The function member 24 acts against the force transmitting element 16, turning it in the counterclockwise direction, and the arm 16*b* acts against the dead locking lever 18, turning it in the clockwise direction against the force of the spring 20 away from its dead locking position. The dead locking member 21 is then able to move out of engagement with the bolt 7, allowing the door to be opened or closed. Correspondingly, when current to the solenoid is switched off, the spring 25 presses the force transmitting element 16 and the function member 24 to the position shown in FIG. 4. Turning of the force transmitting element 16 in the clockwise direction permits the dead locking lever 18 to turn, under the force of the spring 20, in the counterclockwise direction, so that the dead locking lever 18 and the dead locking member 21 are in the dead locking position. Release of the dead locking may thus be independently effected either manually from the operating axis A or electrically by means of the solenoid 23.

FIG. 3 shows the auxiliary bolt 8 protruding from the lock casing. Normally, however, when the door is closed the striking plate for the lock located in the door frame (not shown) prevents movement of the auxiliary bolt 8 out of the lock casing to its protruding position, which thus corresponds to the situation of FIGS. 1*a,* 2 and 4. Since FIG. 3 shows the auxiliary bolt 8 in its protruding position, the door is open. In this position a guiding surface 8*a* of the auxiliary bolt 8 presses the force transmitting element 15 through the protrusion 15*b* to the position shown in FIG. 3, which corresponds functionally to the position of FIG. 2 and in which the dead locking is released as described above. Then the door can be closed by just pushing it. A requirement for the described function of the auxiliary bolt 8 is that the force of the spring 26 is sufficient to overcome the combined forces of the springs 25 and 20.

As is apparent from FIG. 4, when dead locking is engaged the dead locking lever 18 extends behind a support member or retaining member 16*c* attached to the force transmitting element 16, whereby the dead locking cannot be released unless the force transmitting element 16 is turned in the counter clockwise direction, either manually through action from the operating axis A or by means of the solenoid 23.

In FIGS. 2–4 the distance of the operating axis A from the front plate 6 is given by way of example numerically, in millimeters, so as to illustrate the adjustment possibilities for the installation of the follower unit 2 according to the invention. The possibility of adjusting the position of the follower unit, and hence of the operating axis A, is naturally entirely independent of the particular latch bolt arrangement, the arrangement shown in the figures being illustrated by way of example because it offers one advantageous application for the invention.

Correspondingly when one wishes to install operating devices at the operation axis A meeting different locking standards, in accordance with the invention it is possible to select in each case a suitable follower unit 2 which is provided for example with a follower element 12 and other force transmitting members having the specific dimensions required in accordance with the locking standard in question. The invention, however, makes it possible to choose from several different follower units 2 for installation in the same basic lock casing 1. Naturally, by means of the invention it is also possible to create a system which includes several lock casings 1 and different follower units 2 to be installed therein, applicable for different purposes and meeting different locking standards.

The direction of operation of the solenoid means, i.e. whether the solenoid pushes or pulls, may be selected according to need. In case the direction of operation differs from the embodiment shown in the figures, naturally, this must be taken account of in the operation of the rest of the force transmitting elements.

The invention is not limited to the embodiment shown but several modifications are feasible within the scope of the attached claims.

What is claimed is:

1. A lock casing to be installed in a door or the like, comprising:

a front plate, a case-like lock housing attached to the front plate and including a bolt, a follower unit which is releasably fastened to the front plate and includes a follower element which is turnable in the follower unit about an operating axis, the follower element being accessible from at least one side of the door for turning by means of a key operated locking mechanism, at least one spacer element between the front plate and the follower unit, whereby the follower unit is held at a distance from the front plate, the or each spacer element being detachable from both the front plate and tile follower unit and being removable from between the front plate and the follower unit, whereby the or each spacer element can be removed and replaced with another spacer element of different thickness and the distance of the follower unit from the front plate can be adjusted, and a force transmitting means operable, on movement of the follower element, to control operation of the bolt, and wherein the spacer element does not extend between the front plate and the lock housing, whereby position of the lock housing relative to the front plate is not affected by the spacer element.

2. A lock casing according to claim 1, wherein the follower unit is fastened to the lock housing by at least one screw engaging the front plate and the follower unit.

3. A lock casing according to claim 1, wherein the follower unit is fastened to the lock housing by screws and the or each spacer element is formed with holes through which the screws pass.

4. A lock casing according to claim 1, wherein the force transmitting means includes a first force transmitting element mounted in the follower unit and a second force transmitting element mounted in the lock housing, the first and second force transmitting elements cooperating through respective force transmitting surfaces which extend transverse to the front plate.

5. A lock casing according to claim 4, wherein the first force transmitting element is guided for movement perpendicular to the operating axis.

6. A lock casing according to claim 4, wherein the front plate has a length dimension parallel to a line which is perpendicular to the operating axis and the follower unit has two walls with spaced, mutually confronting surfaces for guiding movement of the first force transmitting element parallel to the length dimension of the front plate.

7. A lock casing according to claim 1, wherein the lock housing has two opposite side walls perpendicular to the front plate and the follower unit is disposed at least partly between the side walls of the lock housing.

8. A lock casing according to claim 1, wherein the lock housing and the follower unit have respective guide surfaces which extend perpendicular to the front plate for cooperating to position the follower unit lengthwise of the front plate.

9. A lock casing according to claim 1, wherein the force transmitting means includes a first force transmitting element mounted in the follower unit, a second force transmitting element mounted in the lock housing and a dead locking member which is engageable with the bolt for dead locking the bolt, and the lock casing further comprises a solenoid means arranged to act on the second force transmitting element independently of the first force transmitting element.

10. A lock casing according to claim 1, comprising a dead locking member having a dead locking position in which it blocks movement of the bolt from a protruding position to a retracted position, for dead locking the bolt, and a releasing position in which it allows movement of the bolt from its protruding position to its retracted position, a dead locking control member having a first position, in which it holds the dead locking member in its dead locking position, and a second position, in which it allows the dead locking member to move from its dead locking position to its releasing position, and a spring urging the dead locking control member toward its first position, and wherein when the bolt is in its protruding position, force applied to a lateral surface of the bolt generates a force component urging the bolt toward its retracted position.

11. A lock casing according to claim 10, wherein the force transmitting means includes a first force transmitting element mounted in the follower unit and second and third force transmitting elements mounted in the lock housing, the first, second and third force transmitting elements are mechanically in series, the third force transmitting element is operative, when acted on by the second force transmitting element, to urge the dead locking control member toward its second position, and the lock casing further comprises a solenoid means arranged to act on the third force transmitting element independently of the second force transmitting element for urging the dead locking control member toward its second position.

12. A lock casing to be installed in a door or the like, comprising:

a front plate with a longitudinal dimension, a case-like lock housing attached to the front plate, the lock housing including a bolt, a follower unit which includes a follower element which is turnable in the follower unit about an operating axis, a fastening means for securing the follower unit to the front plate at a position such that the operating axis is perpendicular to a line which is parallel to the longitudinal dimension of the front plate and the follower element is accessible from at least one side of the door for turning by means of a key operated locking mechanism, the fastening means including at least one spacer element positionable between the front plate and the follower unit, whereby the follower unit is held at a distance from the front plate, the or each spacer element being detachable from both the front plate and the follower unit and being removable from between the front plate and the follower unit, whereby the or each spacer element can be removed and replaced with another spacer element of different thickness and the distance of the follower unit from the front plate can be adjusted, and a force transmitting means operable, on movement of the follower element when the follower unit is secured to the lock housing, to control operation of the bolt, and wherein the spacer element does not extend between the front plate and the lock housing, whereby position of the lock housing relative to the front plate is not affected by the spacer element.

13. A lock casing according to claim 12, wherein the fastening means includes at least one screw for engaging the front plate and the or each spacer element is formed with at least one hole through which the screw can pass.

14. A lock casing according to claim 12, wherein the force transmitting means includes a first force transmitting element mounted in the follower unit and a second force transmitting element mounted in the lock housing, the first and second force transmitting elements cooperating through respective force transmitting surfaces which extend transverse to the front plate when the follower unit is fastened to the lock housing.

15. A lock casing according to claim 14, wherein the first force transmitting element is guided for movement perpendicular to the operating axis.

16. A lock casing according to claim 14, wherein the follower unit has two opposite walls with spaced, mutually confronting surfaces for guiding movement of the first force transmitting element perpendicular to the operating axis.

17. A lock casing according to claim 12, wherein the lock housing has two opposite side walls perpendicular to the front plate and the follower unit can be disposed at least partly between the side walls of the lock housing.

18. A lock casing according to claim 12, wherein the lock housing and the follower unit have respective guide surfaces which extend perpendicular to the front plate for cooperating to position the follower unit lengthwise of the front plate.

19. A lock casing according to claim 12, wherein the force transmitting means includes a first force transmitting element mounted in the follower unit, a second force transmitting element mounted in the lock housing and a dead locking member which is engageable with the bolt for dead locking the bolt, and the lock casing further comprises a solenoid means arranged to act on the second force transmitting element independently of the first force transmitting element.

20. A lock casing according to claim 12, comprising a dead locking member having a dead locking position in which it blocks movement of the bolt from a protruding position to a retracted position, for dead locking the bolt, and a releasing position in which it allows movement of the bolt from its protruding position to its retracted position, a dead locking control member having a first position, in which it holds the dead locking member in its dead locking position, and a second position, in which it allows the dead locking member to move from its dead locking position to its releasing position, and a spring urging the dead locking control member toward its first position, and wherein when the bolt is in its protruding position, force applied to a lateral surface of the bolt generates a force component urging the bolt toward its retracted position.

21. A lock casing according to claim 20, wherein the force transmitting means includes a first force transmitting element mounted in the follower unit and second and third force transmitting elements mounted in the lock housing, the first, second and third force transmitting elements are mechanically in series when the follower unit is secured to the lock housing, the third force transmitting element is operative, when acted on by the second force transmitting element, to urge the dead locking control member toward its second position, and the lock casing further comprises a solenoid means arranged to act on the third force transmitting element independently of the second force transmitting element for urging the dead locking control member toward its second position.

22. An article of manufacture including:

a door having an edge, a key operated lock mechanism attached to the door and defining an operating axis at a predetermined distance from the edge of the door, and a lock casing to be installed in the door, the lock casing comprising:

a case-like lock housing including a bolt, a front plate to which the lock housing is attached, for attaching the lock housing to the edge of the door, a follower unit which is releasably fastened to the front plate and includes a follower element which is turnable in the follower unit about a follower axis, the follower element being accessible from at least one side of the door for turning by means of the key operated lock mechanism, at least one spacer element between the front plate and the follower unit, whereby the follower unit is held at a distance from the front plate, the or each spacer element being detachable from both the front plate and the follower unit and being removable from between the front plate and the follower unit, whereby the or each spacer element can be removed and replaced with another spacer element of different thickness and the distance of the follower unit from the front plate can be adjusted, and a force transmitting means operable, on movement of the follower element, to control operation of the bolt, and wherein the thickness of the or each spacer element is such that when the lock casing is installed in the door with the front; plate attaching the lock housing to the edge of the door, the follower axis is at said predetermined distance from the edge of the door, and wherein the spacer element does not extend between the front plate and the lock housing, whereby position of the lock housing relative to the front plate is not affected by the spacer element.

* * * * *

UNITED STATES PATENT AND TRADEMARK OFFICE

CERTIFICATE OF CORRECTION

PATENT NO. : 6,293,131 B1
DATED : September 25, 2001
INVENTOR(S) : Jaakko Lemettinen, Juha Raatikainen, Ari Pirinen It is certified that error appears in the above-identified patent and that said Letters Patent is hereby corrected as shown below:

Column 5,
Line 52, "tile" should be deleted and replaced with -- the --.

Signed and Sealed this

Fifth Day of March, 2002

*Attest:*

*Attesting Officer*

JAMES E. ROGAN
*Director of the United States Patent and Trademark Office*